US005508898A

United States Patent [19]

McGovern

[11] Patent Number: 5,508,898

[45] Date of Patent: Apr. 16, 1996

[54] INTERIOR LIGHTING APPARATUS FOR A REFRIGERATED DISPLAY CASE

[75] Inventor: Christopher McGovern, Allentown, N.J.

[73] Assignee: Delaware Capital Formation Inc., Wilmington, Del.

[21] Appl. No.: 340,932

[22] Filed: Nov. 17, 1994

[51] Int. Cl.[6] ..... F25D 27/00

[52] U.S. Cl. ..... 362/92; 362/126; 362/221; 362/225; 362/297; 62/249; 312/223.5

[58] Field of Search ..... 62/249, 251, 252; 312/116, 223.5; 439/226, 235, 236, 239; 362/92, 126, 133, 217, 218, 221, 225, 226, 373, 297

[56] References Cited

U.S. PATENT DOCUMENTS

| | | | |
|---|---|---|---|
| 2,490,413 | 12/1949 | Burtis | 62/249 |
| 2,495,554 | 1/1950 | Spangler | 62/252 |
| 2,594,066 | 4/1952 | Pabst | 62/252 |
| 2,630,684 | 3/1953 | Strang | 62/97 |
| 3,063,256 | 11/1962 | Lamb | 62/256 |
| 3,304,740 | 2/1967 | Dickson et al. | 62/256 |
| 3,751,653 | 8/1973 | Henry | 362/126 |
| 3,756,038 | 9/1973 | MacMaster et al. | 62/256 |
| 4,017,130 | 4/1977 | Hanson | 312/223.5 |
| 4,302,946 | 12/1981 | Ibrahim | 62/82 |
| 4,326,385 | 4/1982 | Ibrahim | 62/82 |
| 4,341,081 | 7/1982 | Ibrahim | 62/82 |
| 4,369,631 | 1/1983 | Abraham | 62/82 |
| 4,489,995 | 12/1984 | Barr | 312/236 |
| 4,680,942 | 7/1987 | Kooy | 62/256 |
| 4,753,084 | 6/1988 | Aoki | 62/246 |
| 4,803,600 | 2/1989 | Pepping | 362/217 |
| 4,930,321 | 6/1990 | Takahashi | 62/249 |
| 5,086,627 | 2/1992 | Borgen | 62/229 |

*Primary Examiner*—James C. Yeung
*Assistant Examiner*—Alan B. Cariaso
*Attorney, Agent, or Firm*—Sperry, Zoda & Kane

[57] ABSTRACT

An improved lighting apparatus is disclosed for illuminating the interior of a refrigerated display case which uses in combination a unique configuration of a main lighting unit behind the cornice as well as an illumination device under the front edge of each shelf wherein each shelf includes a lightrace extending longitudinally adjacent the front edge thereof for retaining the power supply wires therein and wherein the electrical power is supplied to the lighting means through a one-piece end plug electrical coupling designed to seal the end of the lightrace while simultaneously providing electrical connection to a mounting fixture for a fluorescent lamp. The mounting fixture preferably includes a means for mounting of the lamp therein as well as a coupling adapted to engage the electrical coupling of the one-piece end plug electrical coupling in the end of the lightrace for facilitating powering of the shelf illumination lights. The present design includes a novel ballast retaining chamber behind the cornice as well as several specially designed reflector members to facilitate downward illumination from the main lighting within the upper portion of the housing to fully capture and efficiently direct the lumen output of the fluorescent lamps.

20 Claims, 5 Drawing Sheets

INTERIOR LIGHTING APPARATUS FOR A REFRIGERATED DISPLAY CASE

BACKGROUND OF THE INVENTION

1. Field of the Invention

The present invention deals with the field of devices for illuminating display cases which normally include a plurality of shelves therein for holding of displayed product thereon. The present invention is particularly usable in regard to display cases which are refrigerated and are adapted to retain displayed product therein which requires refrigeration prior to customer purchase. Further the present invention is designed particularly for use with such refrigerated display cases having frontal access openings which are open at all times to allow a consumer the convenience of reaching in and withdrawing a displayed product without requiring the opening of a door or the lifting of a window. Such refrigerated display cases are normally maintained under temperature control by a downwardly extending curtain of cool air which is designed to minimize the escape of refrigerated air outwardly through the frontal access opening.

2. Description of the Prior Art

There are numerous previously patented designs on illumination means for refrigerated display cases including one or more shelves therein for holding of displayed product wherein the refrigerated display case includes an open front to facilitate access to the product such as U.S. Pat. No. 2,594,066 patented Apr. 22, 1952 to R. E. Pabst and assigned to Ed Friedrich Inc. on a "Two-Decker Dairy Self-Service Refrigerator"; and U.S. Pat. No. 2,630,684 patented Mar. 10, 1953 to M. H. Strang and assigned to Sherer-Gillett Company on a "Refrigerated Multiple Shelf Display Case"; and U.S. Pat. No. 3,063,256 patented Nov. 13, 1962 to F. G. Lamb on an "Upright Refrigerator Showcase"; and U.S. Pat. No. 3,756,038 patented Sep. 4, 1973 to M. MacMaster et al and assigned to Emhart Corporation on "Refrigerated Display Equipment"; and U.S. Pat. No. 4,302,946 patented Dec. 1, 1981 to F. Ibrahim and assigned to Tyler Refrigeration Corporation on a "Refrigeration System Using Air Defrost"; and U.S. Pat. No. 4,326,385 patented Apr. 27, 1982 to F. Ibrahim and assigned to Tyler Refrigeration Corporation on a "Refrigerated Merchandiser Cabinet With Air Defrost Ports"; and U.S. Pat. No. 4,341,081 patented Jul. 27, 1982 to F. Ibrahim and assigned to Tyler Refrigeration Corporation on a "Multiband Open Front Refrigerated Case With Air Defrost"; and U.S. Pat. No. 4,369,631 patented Jan. 25, 1983 to F. Abraham and assigned to Tyler Refrigeration Corporation on a "Refrigerated Merchandizer Display Case Adapted For Energy Conservation"; and U.S. Pat. No. 4,680,942 patented Jul. 21, 1987 to H. Kooy on a "Cabinet For Cut-Off Flowers"; and U.S. Pat. No. 4,753,084 patented Jun. 28, 1988 to S. Aoki and assigned to Sanden Corporation on a "Refrigerated Display Cabinet"; and U.S. Pat. No. 4,930,321 patented Jun. 5, 1990 to J. Takahashi and assigned to Sanden Corporation on a "Refrigerated Display Case With Night Cover"; and U.S. Pat. No. 5,086,627 patented Feb. 11, 1992 to A. Borgen and assigned to Margaret Platt Borgen on a "Removable Cooling Unit For Display Case And Method For Using Same".

SUMMARY OF THE INVENTION

The present invention provides an improved interior lighting apparatus for a refrigerated display case having a plurality of shelves located therein for holding of displayed product. The refrigerated display case within which the improved lighting apparatus is used will include a main housing having a refrigerated chamber defined therein to hold this displayed product. The main housing further includes a frontal access opening therein which provides access to product displayed within the refrigerated chamber without requiring the user to open a door or lift a window.

One or more shelves may be positioned within the refrigerated chamber of the main housing for holding product. Each of these shelves preferably includes a lightrace extending longitudinally along the front edge of each shelf. The design of the shelves herein allow the product retainer fence and ticket molding to attach to the front end of the individual shelves thereby providing sufficient space beneath the shelving to facilitate positioning of the lightrace immediately therebelow. These lightraces will include two lightrace end openings, each positioned at longitudinally opposite ends of each individual lightrace.

An upper lighting apparatus is included which is secured to the main housing within the refrigerated chamber immediately above the frontal access opening and above the shelves for illumination of displayed product therebelow. This upper lighting apparatus includes an upper lighting housing having a ballast retaining chamber defined therein for holding of the individual ballast members normally required with the fluorescent lighting used with the upper lighting apparatus and the shelf lamps. Positioning of the ballasts at a location outside of the refrigerated zone aids in optimizing the refrigeration performance of the unit. The upper housing further includes a tab means extending outwardly therefrom and a shoulder member extending therealong which is spatially disposed from the tab. These devices are designed for facilitating holding of a reflector with respect to the housing without requiring any fasteners. Since no fasteners are required the ballasts can be replaced or at least accessed without requiring any additional operations or special tools. This reflector can be formed with a profile having a plurality of straight sections joined at obtuse angles with respect to one another. Preferably, the multiple sections with be formed as a single integral member. Also, the reflector will preferably be of a polished aluminum material.

An upper lighting fixture is included mounted in the upper lighting housing below the ballast retaining chamber and is adapted to receive a light device mounted therein. The upper lighting device itself is preferably detachably mountable with respect to the upper lighting fixture in such a manner as to illuminate the case therebelow. This upper lighting device preferably includes a first fluorescent lamp and a second fluorescent lamp extending parallel with respect to one another with the second lamp being lower than the first lamp and being immediately adjacent to the uppermost edge of the frontal access opening to provide an inclined rearwardly facing pair of lamps within this upper portion of the refrigerated display case to facilitate illumination of shelving and product displayed thereon.

An upper light reflector is secured to the upper lighting housing in a position between the upper lighting device and the main housing in order to facilitate the reflection of light from the upper lighting device downwardly on to the products and other items within the refrigerated display case. Preferably the upper light reflector is detachably secured to the upper lighting housing to facilitate cleaning and/or replacement thereof as needed. The upper light reflector preferably comprises a reflector plate member formed of a polished aluminum which has a general concave downwardly extending shape. This reflector plate member includes an engagement aperture therein which is adapted to be capable of engaging with the tab of the upper lighting housing. Once this tab is engaged with this aperture then the reflector plate member which is flexibly resilient can be slightly flexed and positioned immediately behind the shoulder defined by the upper lighting housing in such a manner as to detachably retain the reflector plate member with respect to the upper lighting housing without the use of fasteners. The reflector plate member preferably also includes a lateral profile of a plurality of adjacently positioned straight sections interconnected at obtuse angles in order to form this generally downwardly facing concave shape. It has been found that such a profile significantly enhances the downward reflective characteristics of a given reflector member by virtue of the efficiently directed lumen output of the lamps.

The present design further includes a shelf mounted lighting apparatus positioned immediately below the front edge of each shelf for illumination therebelow. The shelf mounted lighting apparatus preferably includes a shelf lighting device such as a lamp mounted below the shelf for illumination. Two end plug electrical couplings preferably are included mounted within each opposite end of the lightrace. These end plug electrical couplings each include an end plug member adapted to be positioned within the lightrace end opening for closing thereof to limit access therein and to enhance cleanliness. This tombstone-shaped member is self-locating in that it requires no fasteners for mounting as a result of being housed between the shelf bracket and the edge of the shelf top pan. This end plug electrical member also preferably includes a first electrical connector comprising preferably a female plug member which is integral with respect to the end plug member for housing and providing power to a fluorescent lamp and includes an electrical wire device extending from the first electrical connector through the electrical plug member into the lightrace means in order to facilitate the supplying of electrical power to the lighting device mounted below each shelf.

The shelf lighting fixture preferably is mounted below the shelf and includes a second electrical connector comprising preferably a male plug member. This second electrical connector is integral with the shelf lighting fixture and is detachably engageable with respect to the first electrical connector of the end plug electrical coupling for achieving electrical contact. The shelf lighting fixture further includes a mounting fixture integral with the second electrical connector to receive electrical power therefrom. This mounting fixture is adapted to detachably receive the shelf lighting device mounted therein in electrical communication with respect to the second electrical connector to thereby receive electrical power for supplying thereof to the shelf lighting means.

The design of the shelving in the present invention can include a mounting flange positioned on the front edge of each shelf which preferably may include a product retaining fence mounted on the front end thereof and extending upwardly from each shelf to facilitate retaining of product to be displayed upon the shelf. It can also include, in the alternative, or, in addition, a ticket molding also mounted to the front end of the shelving which facilitates the display of pricing information on the front of the shelf and provides sufficient space immediately beneath the front end of the shelf for positioning of the lightrace.

It is an object of the present invention to provide an improved interior lighting apparatus for a refrigerated display case having at least one shelf therein for holding of displayed product thereon wherein a ballast retaining chamber is located above the main upper lighting fixture.

It is an object of the present invention to provide an improved interior lighting apparatus for a refrigerated display case having at least one shelf therein for holding of displayed product thereon wherein the main upper lighting apparatus includes a highly polished aluminum reflector member for facilitating illumination downwardly therefrom.

It is an object of the present invention to provide an improved interior lighting apparatus for a refrigerated display case having at least one shelf therein for holding of displayed product thereon wherein the main upper lighting fixture includes a reflector member detachably secured between the lighting device and the upper housing.

It is an object of the present invention to provide an improved interior lighting apparatus for a refrigerated display case having at least one shelf therein for holding of displayed product thereon wherein one or more shelves are included having an illumination means immediately below the front edge thereof.

It is an object of the present invention to provide an improved interior lighting apparatus for a refrigerated display case having at least one shelf therein for holding of displayed product thereon wherein each individual shelf defines a lightrace with end plugs therein for limiting access thereto and enhancing cleanliness therewithin.

It is an object of the present invention to provide an improved interior lighting apparatus for a refrigerated display case having at least one shelf therein for holding of displayed product thereon wherein each lightrace adjacent the front edge of each shelf preferably includes two end plug units, each having an electrical connector which is engageable with respect to a lamp mounting fixture to facilitate illumination therebelow.

It is an object of the present invention to provide an improved interior lighting apparatus for a refrigerated display case having at least one shelf therein for holding of displayed product thereon wherein energy conservation is maximized.

It is an object of the present invention to provide an improved interior lighting apparatus for a refrigerated display case having at least one shelf therein for holding of displayed product thereon wherein energy is conserved by the use of reflectors which combine with more energy efficient lamps to deliver comparable lumen output to that achieved with higher output but less energy efficient lamps.

It is an object of the present invention to provide an improved interior lighting apparatus for a refrigerated display case having at least one shelf therein for holding of displayed product thereon wherein initial cost outlays are minimized.

It is an object of the present invention to provide an improved interior lighting apparatus for a refrigerated display case having at least one shelf therein for holding of displayed product thereon wherein manufacturing costs are minimized.

It is an object of the present invention to provide an improved interior lighting apparatus for a refrigerated display case having at least one shelf therein for holding of displayed product thereon wherein down-time is minimized.

It is an object of the present invention to provide an improved interior lighting apparatus for a refrigerated display case having at least one shelf therein for holding of displayed product thereon wherein maintenance requirements are significantly reduced.

It is an object of the present invention to provide an improved interior lighting apparatus for a refrigerated display case having at least one shelf therein for holding of displayed product thereon wherein the main upper lighting fixture is angularly inclined with respect to the refrigerated display case therebelow so as to better direct light.

It is an object of the present invention to provide an improved interior lighting apparatus for a refrigerated display case having at least one shelf therein for holding of displayed product thereon wherein a combination ticket molding and product retainer fence can be formed integrally and secured with respect to the front edge of the individual shelves immediately adjacent the illumination means therebelow without holes in the shelf top pan to allow positioning of a lightrace immediately below the front edge of the shelf.

It is an object of the present invention to provide an improved interior lighting apparatus for a refrigerated display case having at least one shelf therein for holding of displayed product thereon wherein the main upper lighting apparatus includes one or more reflector plate members formed of a plurality of straight sections interconnected with respect to one another at obtuse angles to enhance reflectance downwardly therefrom.

It is an object of the present invention to provide an improved interior lighting apparatus for a refrigerated display case having at least one shelf therein for holding of displayed product thereon wherein the lightrace can be easily attached and detached from a shelf without requiring fasteners or special tools.

It is an object of the present invention to provide an improved interior lighting apparatus for a refrigerated display case having at least one shelf therein for holding of displayed product thereon wherein assembly can be achieved without any holes in the shelf top pan to thereby enhance sanitation and electrical safety.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
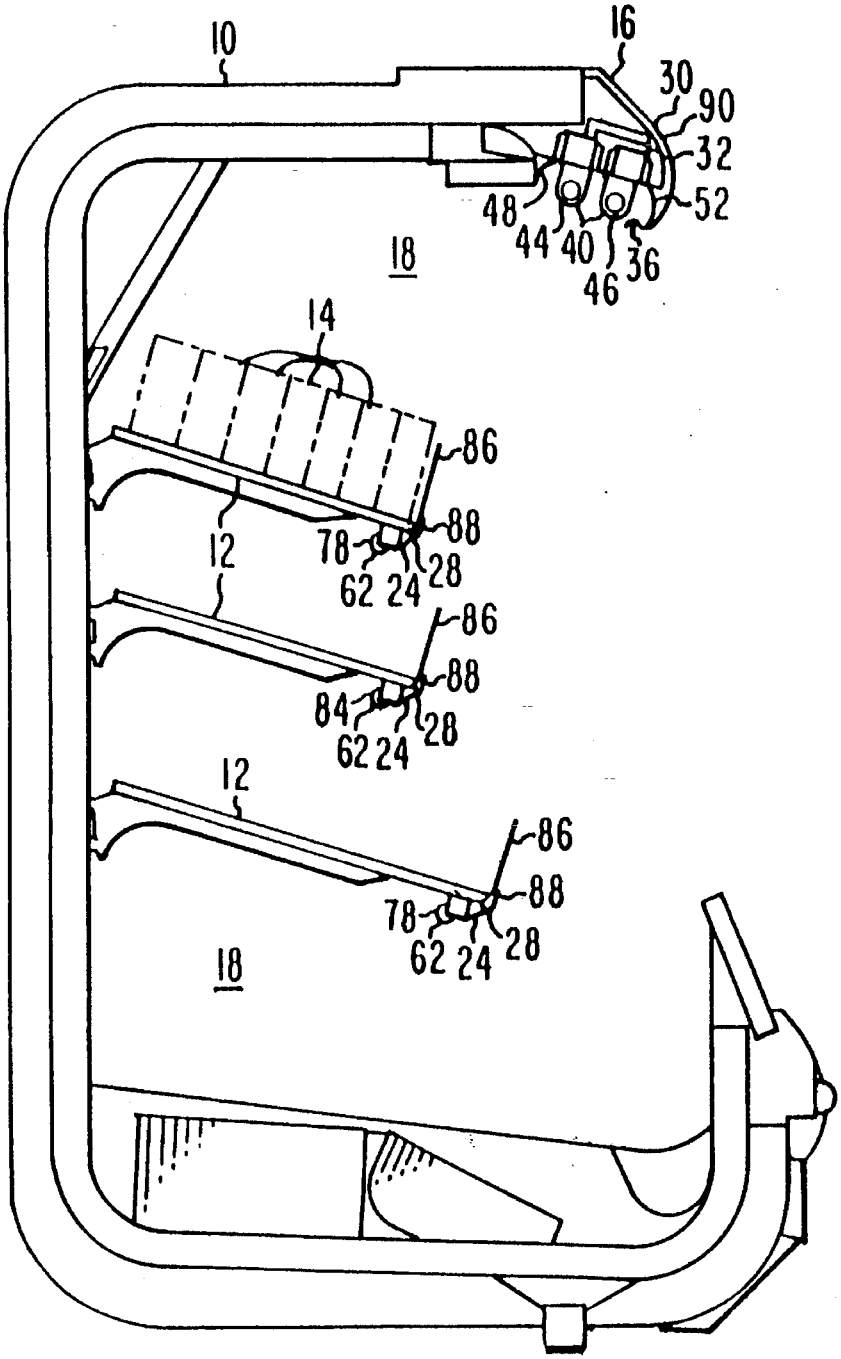
FIG. 1 is a side cross sectional view of an embodiment of a refrigerated display case of the present invention showing an embodiment of the improved interior lighting apparatus therein.

The present invention provides a refrigerated display case 10 adapted to include a plurality of shelves 12 therein for holding of displayed product 14 thereon. The refrigerated display case 10 preferably includes a main housing 16 defining a refrigerated chamber means 18 therein. The refrigerated display case 10 also defines a frontal access opening 20 therein to facilitate the removal of displayed product 14 by a customer.

Each of the shelves 12 preferably includes a lightrace 24 extending along and below the front edge 28 of the shelf. This lightrace 24 will preferably define a lightrace end opening 26 at each lateral end of the lightrace 24.

Figure 5:
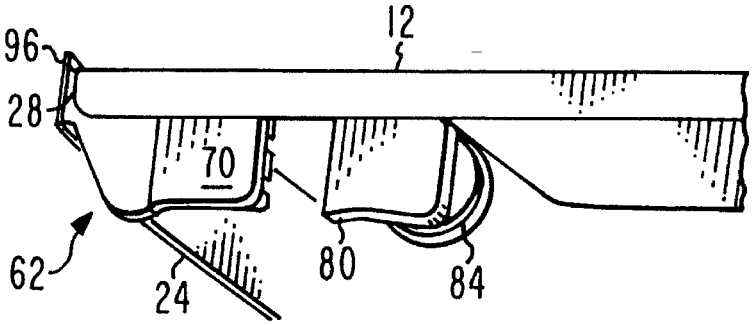
FIG. 5 is a side view of an embodiment of a shelf of the present invention showing the shelf mounted lighting apparatus partly assembled.
Figure 6:
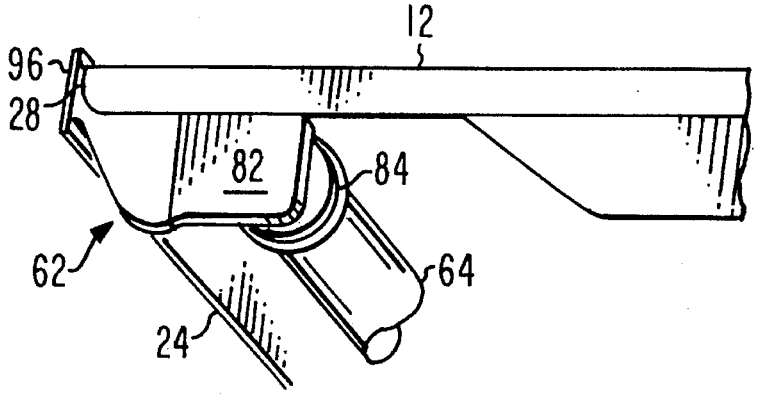
FIG. 6 is a side plan view of the embodiment shown in FIG. 5 in the assembled position.
Figure 4:
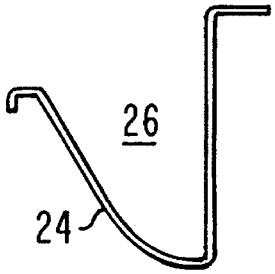
FIG. 4 is a side plan view of an embodiment of the part which is capable of being mounted to the lower front edge of a shelf to define the lightrace with two open ends therein.
Figure 7:
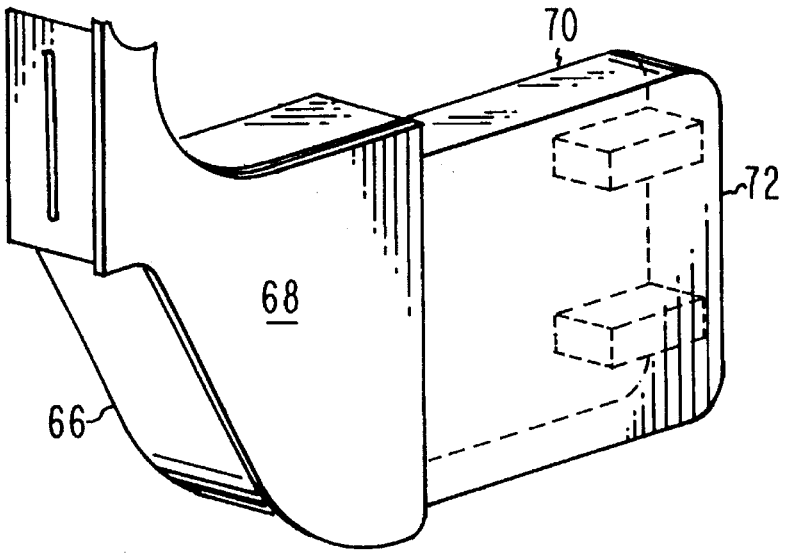
FIG. 7 is a front perspective illustration of an embodiment of the end plug electrical coupling of the present invention.
Figure 8:
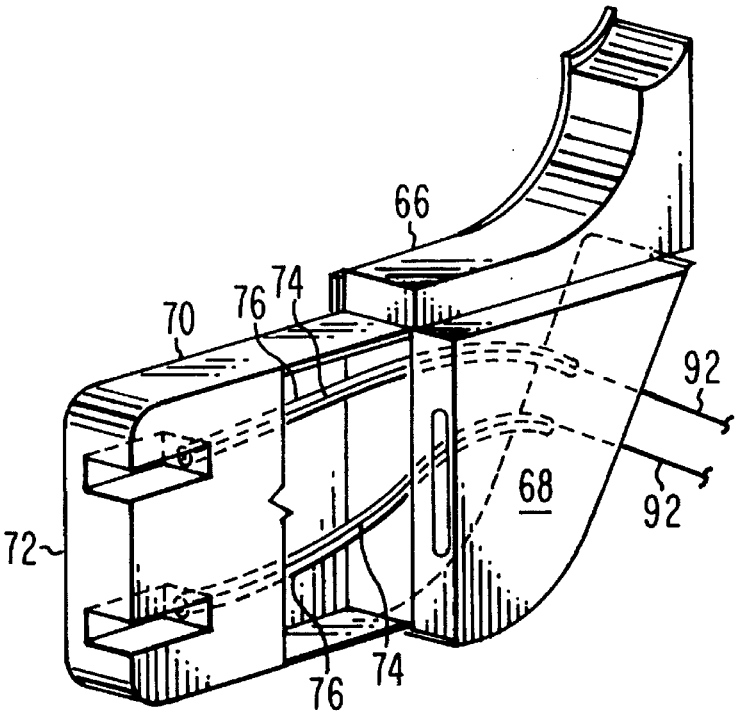
FIG. 8 is a rear perspective illustration of the embodiment shown in FIG. 7.
Figure 9:
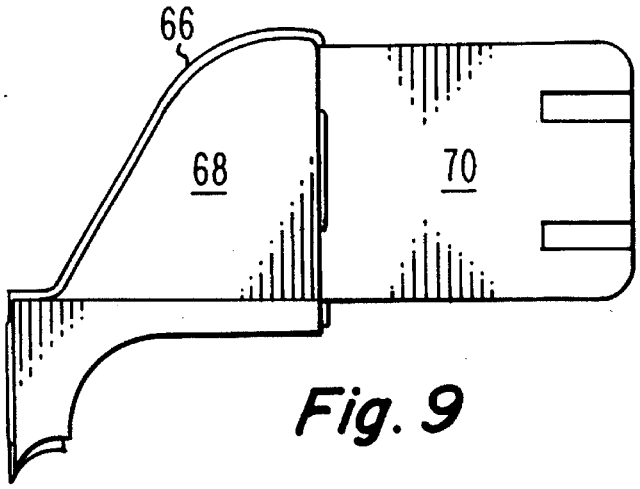
FIG. 9 is a rear plan view of the embodiment shown in FIG. 7.
Figure 10:
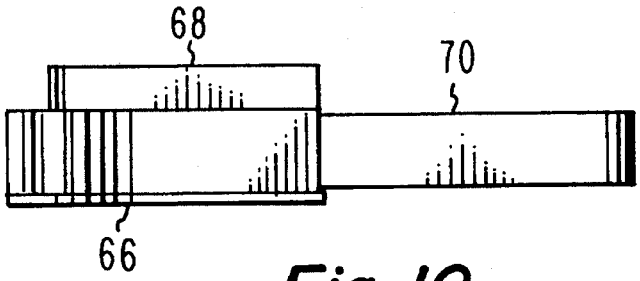
FIG. 10 is a top plan view of the embodiment shown in FIG. 7.
Figure 11:
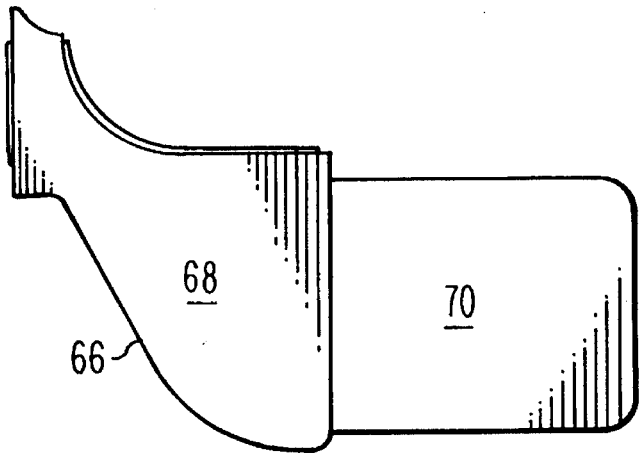
FIG. 11 is a front plan view of the embodiment shown in FIG. 7.

Each shelf will preferably include a shelf-mounted lighting apparatus 62 which is designed to hold a shelf lighting means such as a fluorescent lamp therein. Such lamps as the "T-8" lamp are usable in refrigerated display cases currently in view of their high energy conservation and small diameter. Each shelf-mounted lighting apparatus 62 will usually include two of the end plug electrical couplings 66 as shown in FIGS. 7 through 11. This end plug electrical coupling 66 will include two members integrally secured with respect to one another. First, the coupling 66 includes an end plug member 68 which is adapted to be positioned within the lightrace end opening 26 of lightrace 24 as shown best in FIGS. 5 and 6. Secondly, the end plug electrical coupling 66 will also include a first electrical connector 70 integral with the end plug member 68 and extending outwardly therefrom. This first electrical connector 70 will be adapted to be engageable with respect to a second electrical connector 80 which is integrally formed with respect to the shelf lighting fixture means 78. Shelf lighting fixture means 78 is configured as shown best in FIGS. 5 and 6 and can include a round portion for engagement with respect to a T-8 lamp or any other lighting member and also includes the second electrical connector 80 which is engageable with respect to the first electrical connector 70. In the configuration shown in FIGS. 5 and 6 the first electrical connector 70 is defined as a female plug member 72 and the second electrical connector 80 is defined as a male plug member 82. The mounting fixture 84 which is then integrally connected with respect to the second electrical connector 80 to form the entire configuration of the shelf lighting fixture 78.

An electrical wire means 74 or other electrical interconnecting means may extend from the first electrical connector 70 of the end plug electrical coupling 66 through the first electrical connector 70 and then through the end plug member 68 to exit therefrom into the lightrace 24 within which the end plug member 68 is positioned. To facilitate positioning of this electrical connector means 74 an internal passageway 76 may be defined within the first electrical connector 70 and the end plug member 68.

Figure 2:
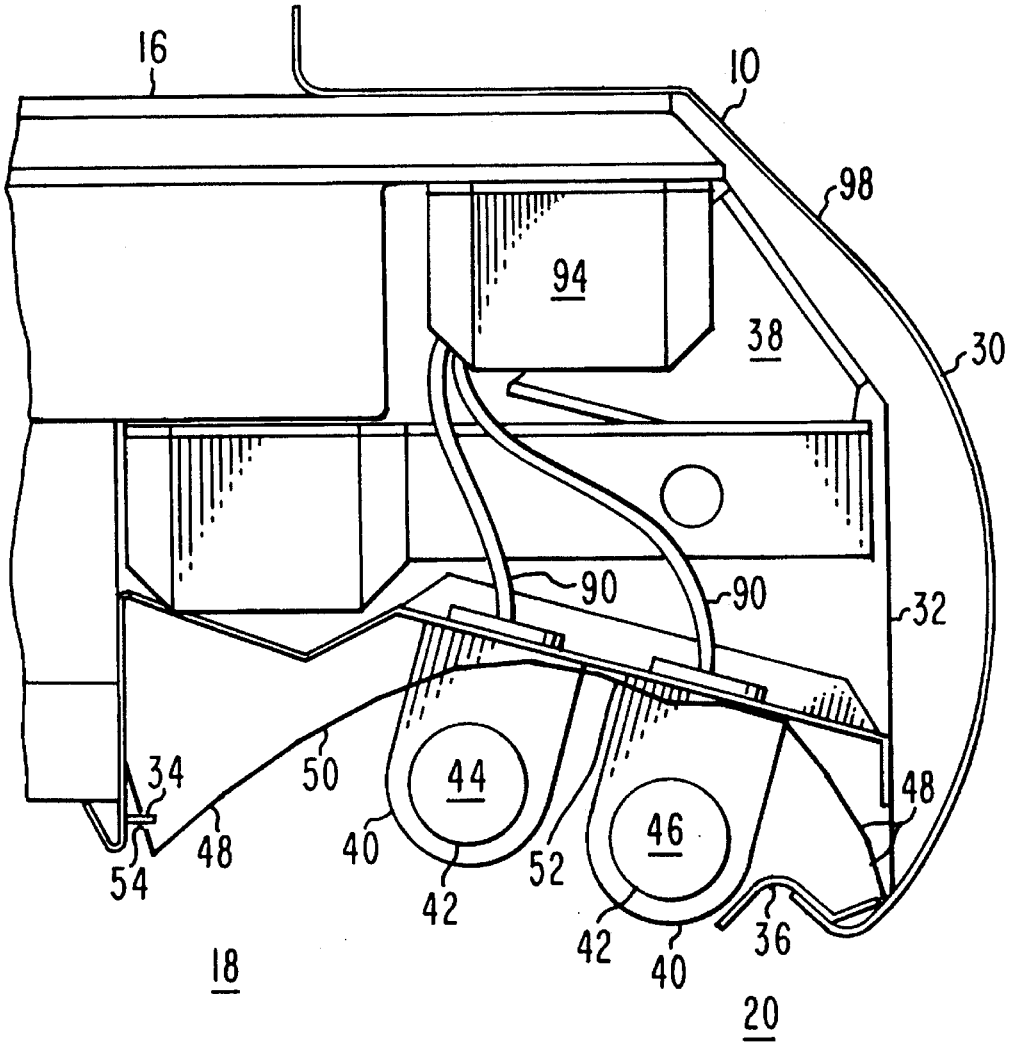
FIG. 2 is a side cross sectional view of an embodiment of the upper lighting apparatus of the improved interior lighting apparatus for the refrigerated display case of the present invention.

The improved lighting apparatus of the present invention further includes an upper lighting apparatus 30 which can include an upper lighting housing 32 which defines a ballast retaining chamber 38 upwardly therein. The positioning of the ballast 94 within the ballast retaining chamber 38 can include a ballast electrical line 90 extending therefrom to facilitate connection to a lighting means such as a fluorescent lamp therebelow. This ballast retaining chamber 38 is adapted to hold a ballast member 94 therein commonly required for use with the conventionally used fluorescent light fixtures within refrigerated display cases. The upper lighting housing 32 also includes an upper lighting fixture means 78 mounted therein and an upper lighting means 42 such as a fluorescent or other lamp. The upper lighting member 42 can include a first light member 44 and a second light member 46 positioned parallel with respect to one another. In this preferred configuration the second light member 46 will be located slightly below and toward the front of the refrigerated display case 10 from the first light member 44 in such a manner as to provide an inclined angle of illumination of product within the refrigerated chamber 16 of the display case 10. This configuration with the second light member 46 slightly forwardly and downwardly from the first light member 44 and closer to the upper edge of the frontal access opening 20 is best shown in FIGS. 1 and 2.

To enhance illumination by the upper lighting housing 32 an upper light reflector 48 such as a reflector plate member 50 can be positioned between the upper light device 42 and the upper lighting housing 32. This reflector plate member preferably is of a highly polished aluminum to enhance reflectance thereof. Furthermore the reflector plate member preferably has a concave shape 52 such that it is directed with the open end facing downwardly toward the displayed product 14 in the refrigerated display case 10 therebelow. This reflector plate 50 is preferably secured in a position between the lighting means 42 and the upper light housing 32.

Preferably the upper lighting housing 32 defines a tab means 34 extending outwardly therefrom and a shoulder means 36 extending therealong at a space positioned from the tab 34. With this configuration the reflector plate member 50 will then preferably define an engagement aperture 54 therein which is adapted to receive the tab means 34 extending therein to facilitate mounting of the reflector plate 50 in the proper position adjacent the upper lighting means 42. In a similar manner the reflector plate member 50 is preferably of a flexibly resilient material to allow it to be slightly flexed while the engagement aperture 54 thereof is engageable with respect to the tab 34 and can be positioned with the opposite end behind the shoulder 36 in such a manner as to provide a snap-in engagement with the upper lighting housing 32.

Figure 12:
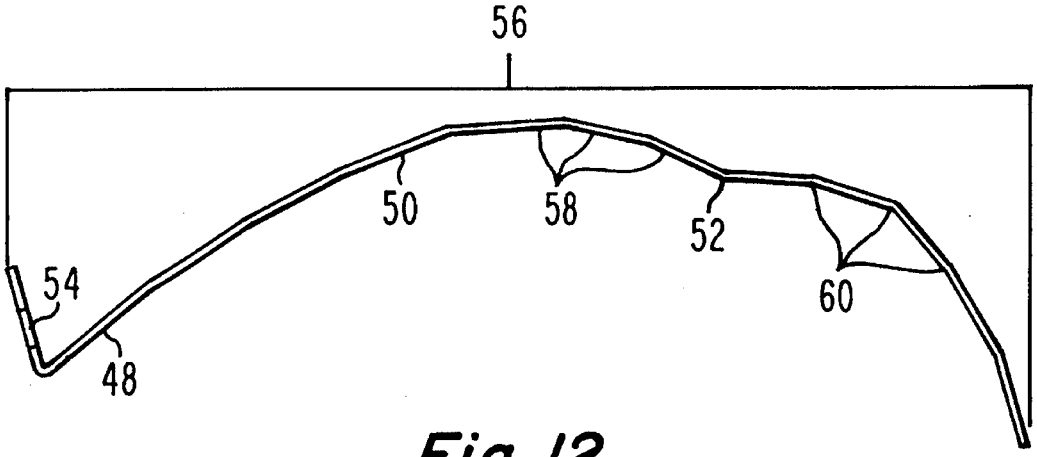
FIG. 12 is a side plan view showing an embodiment for the profile of an upper light reflector usable with the present invention.
Figure 3:
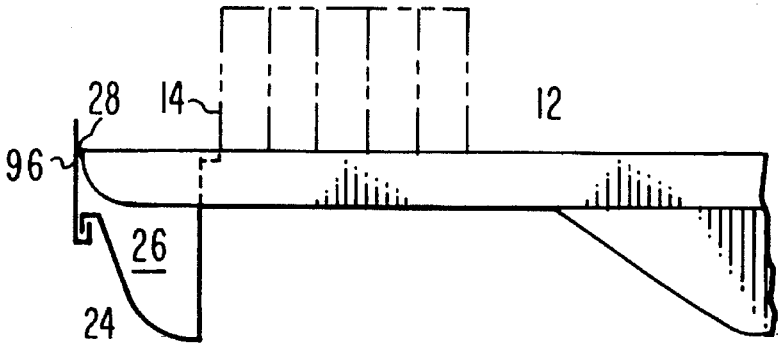
FIG. 3 is a side plan view of an embodiment of a shelf of the present invention showing an embodiment of the lightrace mounted adjacent the front edge thereof.

Preferably the lateral profile 56 of the reflector plate member 50 will include a plurality of straight sections 58 interconnected with respect to one another by obtuse angles 60. Such obtuse angles 60 are all greater than 90 degrees and, as such, when formed adjacent to one another as shown best in FIG. 12 provide enhanced reflectance characteristics for the upper light reflector 48.

With the apparatus of the present invention preferably each of the shelves includes a shelf front mounting flange 96 which is adapted to receive a product retaining fence 86 and/or a ticket molding 88 thereon. By positioning of the mounting flange 96 on the frontmost edge of the shelf, sufficient space can be provided immediately therebelow to locate the lightrace. Positioning of the lightrace below the front edge of the shelf allows the shelf lighting to be also positioned closely to the front edge of the shelf thereby increasing the effective lighting generated downwardly therefrom. The product retaining fence 86 can be separate from the ticket molding 88 or can be integral therewith or the ticket molding 88 can be used without the fence 86 or the fence 86 can be used without the ticket molding 88. In either case the positioning of the shelf illumination means extending therebelow are not effected by the use of the ticket molding 88 for displaying product pricing information or the display of the product retaining fence 86 for facilitating the retaining of displayed product 14 upon shelves 12. In the shelving of the prior art, the ticket molding or the product fence would attached below the front edge of the shelf thereby requiring positioning of shelf lighting at a location spaced from the front shelf edge. The configuration of the fence 86 and molding 88 of the present invention, attached to the shelf mounting flange 96 allows positioning of the shelf lighting means immediately below the front edge of the product shelving.

As such, with the improved configuration for the lighting apparatus of the present invention the upper lighting apparatus 30 provides enhanced downward illumination due to the inclined angle of the upper lighting apparatus 30 with respect to the refrigerated chamber 18 therebelow. Also the light characteristics therebelow are significantly enhanced in view of the unique advantages of the configuration of the upper light reflector 48.

This unique upper lighting configuration positioned immediately behind the cornice 98 adjacent the upper end of the frontal access opening 20 is of particular advantage when used in combination with the shelf lighting configuration utilizing the single piece end plug electrical coupling 66 which is adapted to communicate electrical power from the interior of the lightrace 24 directly to the shelf lighting fixture 78 while simultaneously providing an end plug member 68 for the end openings 26 of lightrace 24.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An improved interior lighting apparatus for a refrigerated display case having a plurality of shelves located therein for holding of displayed product thereon, which comprises:

A. a main housing defining a refrigerated chamber means therein to hold displayed product, said main housing further defining a frontal access opening means therein to provide access to product displayed within said refrigerated chamber means;

B. a shelf means secured to said main housing within said refrigerated chamber for holding product displayed thereon, said shelf means defining a lightrace means extending longitudinally along the front edge of said shelf means, said lightrace means defining at least one lightrace end opening means therein;

C. an upper lighting apparatus secured to said main housing within said refrigerated chamber means above said shelf means for illumination of displayed product positioned therebelow within said refrigerated chamber means, comprising:

(1) an upper lighting housing defining a ballast retaining chamber therein;

(2) an upper lighting fixture means mounted in said upper lighting housing below said ballast retaining chamber and being adapted to receive a lighting means mounted therein;

(3) an upper lighting means being detachably mountable with respect to said upper lighting fixture means to illuminate therebelow within said refrigerated chamber means;

(4) an upper light reflector means being detachably securable to said upper lighting housing in a position between said upper lighting means and said main housing to facilitate reflection of light from said upper lighting means downwardly for illumination within said refrigerated chamber means therebelow;

a shelf-mounted lighting apparatus secured with respect to said shelf means for illumination of displayed product within said refrigerated chamber means therebelow, said shelf-mounted lighting apparatus comprising:

(1) shelf lighting means mounted below said shelf means for illumination therebelow;

(2) an end plug electrical coupling including an end plug member adapted to be positioned over said lightrace end opening means for closing thereof to limit access therein and to enhance cleanliness thereof, said end plug electrical coupling also including a first electrical connector integral with said end plug member and including an electrical wire means extending from said first electrical connector through said end plug member into said lightrace means to facilitate supplying of electrical power to said shelf lighting means;

(3) a shelf lighting fixture means mounted below said shelf means and including a second electrical connector integral therewith being detachably engageable with respect to said first electrical connector of said end plug electrical coupling for achieving electrical communication therebetween, said shelf lighting fixture means also including a mounting fixture means integral with said second electrical connector to receive electrical power therefrom, said mounting fixture means being adapted to detachably receive said shelf lighting means mounted therein in electrical communication with respect to second electrical connector to receive electrical power therefrom for supplying electrical power to said shelf lighting means for illumination of displayed product positioned within said refrigerated chamber means therebelow.

2. An improved interior lighting apparatus for a refrigerated display case having a plurality of shelves located therein for holding of displayed product thereon as defined in claim 1 wherein said upper lighting apparatus is positioned within said main housing immediately adjacent the upper edge of said frontal access opening to facilitate illumination of said refrigerated chamber means therebelow.

3. An improved interior lighting apparatus for a refrigerated display case having a plurality of shelves located therein for holding of displayed product thereon as defined in claim 1 wherein said upper lighting means includes:

A. a first light member; and

B. a second light member extending parallel with respect to said first light member and being closer to said frontal access opening means and positioned lower than said first light member to provided said upper lighting means inclined facing rearwardly into said refrigerated chamber means to facilitate illumination therein.

4. An improved interior lighting apparatus for a refrigerated display case having a plurality of shelves located therein for holding of displayed product thereon as defined in claim 1 wherein said upper light reflector means comprises a reflector plate member being generally concave is shape facing downwardly to facilitate illumination therebelow.

5. An improved interior lighting apparatus for a refrigerated display case having a plurality of shelves located therein for holding of displayed product thereon as defined in claim 4 wherein said upper lighting housing defines a shoulder member to facilitate mounting of said reflector plate member with respect thereto, and wherein said reflector plate member is of flexibly resilient material to allow positioning thereof behind said shoulder member to facilitate engagement of said reflector plate member to said upper lighting housing between said upper lighting means and said main housing.

6. An improved interior lighting apparatus for a refrigerated display case having a plurality of shelves located therein for holding of displayed product thereon as defined in claim 4 wherein said upper lighting housing defines a tab means extending outwardly therefrom, and wherein said reflector plate member is of a flexibly resilient material and defines an engagement aperture therein engageable with respect to said tab means to facilitate retaining of said reflector plate member to said upper lighting housing between said upper lighting means and said main housing.

7. An improved interior lighting apparatus for a refrigerated display case having a plurality of shelves located therein for holding of displayed product thereon as defined in claim 1 wherein said upper light reflector means is made of highly polished aluminum to enhance reflecting properties thereof.

8. An improved interior lighting apparatus for a refrigerated display case having a plurality of shelves located therein for holding of displayed product thereon as defined in claim 1 wherein said reflector plate member includes a lateral profile having a plurality of adjacently positioned straight sections interconnected at obtuse angles to form a downwardly facing generally concave shape.

9. An improved interior lighting apparatus for a refrigerated display case having a plurality of shelves located therein for holding of displayed product thereon as defined in claim 1 wherein said lightrace means is positioned under said shelf means immediately adjacent the front edge thereof.

10. An improved interior lighting apparatus for a refrigerated display case having a plurality of shelves located therein for holding of displayed product thereon as defined in claim 1 wherein said shelf means comprises a plurality of individual shelf members, each adapted to retain and display product thereon.

11. An improved interior lighting apparatus for a refrigerated display case having a plurality of shelves located therein for holding of displayed product thereon as defined in claim 1 wherein said shelf-mounted lighting apparatus is positioned under said shelf means immediately adjacent the front edge thereof to facilitate downward illumination therefrom.

12. An improved interior lighting apparatus for a refrigerated display case having a plurality of shelves located therein for holding of displayed product thereon as defined in claim 1 further comprising a product retaining fence secured to the front edge of said shelf means and extending upwardly therefrom to facilitate retaining of product to be displayed thereon.

13. An improved interior lighting apparatus for a refrigerated display case having a plurality of shelves located therein for holding of displayed product thereon as defined in claim 12 further comprising a ticket molding integrally formed with said product retaining fence to facilitate display of pricing information on said shelf means.

14. An improved interior lighting apparatus for a refrigerated display case having a plurality of shelves located therein for holding of displayed product thereon as defined in claim 1 further including power supply wire means extending through said lightrace means and being electrically connected to said electrical wire means to supply electrical power thereto for illumination of said shelf lighting means.

15. An improved interior lighting apparatus for a refrigerated display case having a plurality of shelves located therein for holding of displayed product thereon as defined in claim 1 further comprising ballast electrical line means electrically in communication with said upper lighting means and extending from said upper lighting fixture means into said ballast retaining chamber to facilitate supply of electrical power to said upper lighting means and said shelf lighting means.

16. An improved interior lighting apparatus for a refrigerated display case having a plurality of shelves located therein for holding of displayed product thereon as defined in claim 1 wherein said first electrical connector of said end plug electrical coupling comprises a female plug member.

17. An improved interior lighting apparatus for a refrigerated display case having a plurality of shelves located therein for holding of displayed product thereon as defined in claim 1 wherein said second electrical connector of said shelf lighting fixture means comprises a male plug member.

18. An improved interior lighting apparatus for a refrigerated display case having a plurality of shelves located therein for holding of displayed product thereon as defined in claim 1 wherein said end plug electrical coupling defines an internal passageway with said electrical wire means extending therethrough to supply electrical power from said lightrace means to said first electrical connector.

19. An improved interior lighting apparatus for a refrigerated display case having a plurality of shelves located therein for holding of displayed product thereon as defined in claim 1 wherein said end plug member of said end plug electrical coupling is positioned within said lightrace means within said lightrace end opening means for selective sealing thereof.

20. An improved interior lighting apparatus for a refrigerated display case having a plurality of shelves located therein for holding of displayed product thereon, which comprises:

A. a main housing defining a refrigerated chamber means therein to hold displayed product, said main housing further defining a frontal access opening means therein to provide access to product displayed within said refrigerated chamber means;

B. a plurality of shelf means secured to said main housing within said refrigerated chamber for holding product displayed thereon, each of said shelf means defining a lightrace means extending longitudinally along the front edge thereof, each of said lightrace means defining at least one lightrace end opening means therein;

C. an upper lighting apparatus secured to said main housing within said refrigerated chamber means immediately above said frontal access opening and above said shelf means for illumination of displayed product positioned therebelow within said refrigerated chamber means, comprising:

(1) an upper lighting housing defining a ballast retaining chamber therein, said upper lighting housing further including a tab means extending outwardly therefrom and a shoulder member spatially disposed from said tab means;

(2) an upper lighting fixture means mounted in said upper lighting housing below said ballast retaining chamber and being adapted to receive a lighting means mounted therein;

(3) a upper lighting means being detachably mountable with respect to said upper lighting fixture means to illuminate therebelow within said refrigerated chamber means, said upper lighting means including;

(a) a first light member; and (b) a second light member extending parallel with respect to said first light member and being closer to said frontal access opening means and positioned lower than said first light member to provided said upper lighting means inclined facing rearwardly into said refrigerated chamber means to facilitate illumination therein;

(4) an upper light reflector means being detachably securable to said upper lighting housing in a position between said upper lighting means and said main housing to facilitate reflection of light from said upper lighting means downwardly for illumination within said refrigerated chamber means therebelow, said upper light reflector means including a reflector plate member of polished aluminum being generally concave facing downwardly into said refrigerated chamber means, said reflector plate member defining an engagement aperture therein being selectively engageable with said tab means of said upper lighting housing, said reflector plate member being flexibly resilient to facilitate engagement of said engagement aperture thereof with respect to said tab means and to allow engagement of said reflector plate member with respect to said shoulder member for detachably securing of said reflector plate member with respect to said upper lighting housing, said reflector plate member includes a lateral profile having a plurality of adjacently positioned straight sections interconnected at obtuse angles to form a downwardly facing generally concave shape;

D. a plurality of shelf-mounted lighting apparatus secured with respect to each of said shelf means immediately below the front edge thereof for illumination of displayed product within said refrigerated chamber means therebelow, each of said shelf-mounted lighting apparatus comprising:

(1) a shelf lighting means mounted below said shelf means for illumination therebelow;

(2) an end plug electrical coupling including an end plug member adapted to be positioned within said lightrace end opening means for closing thereof to limit access therein and to enhance cleanliness thereof, said end plug electrical coupling also including a first electrical connector comprising a female plug member and being integral with said end plug member and including an electrical wire means extending from said first electrical connector through said end plug member into said lightrace means to facilitate supplying of electrical power to said shelf lighting means;

(3) a shelf lighting fixture means mounted below said shelf means and including a second electrical connector comprising a male plug member, said second electrical connector being integral with said shelf lighting fixture means and being detachably engageable with respect to said first electrical connector of said end plug electrical coupling for achieving electrical communication therebetween, said shelf lighting fixture means also including a mounting fixture means integral with said second electrical connector to receive electrical power therefrom, said mounting fixture means being adapted to detachably receive said shelf lighting means mounted therein in electrical communication with respect to second electrical connector to receive electrical power therefrom for supplying electrical power to said shelf lighting means for illumination of displayed product positioned within said refrigerated chamber means therebelow;

E. a product retaining fence secured to the front edge of each of said shelf means and extending upwardly therefrom to facilitate retaining of product to be displayed thereon; and F. a ticket molding integrally formed with respect to each said product retaining fence to facilitate display of pricing information on said shelf means.

* * * * *